US005412939A

United States Patent [19]

Hover et al.

[11] Patent Number: 5,412,939

[45] Date of Patent: May 9, 1995

[54] SEAL COMPRESSION TOOL FOR GAS TURBINE ENGINE

[75] Inventors: Forest H. Hover, Chandler; Henry J. Ruzicka, Mesa, both of Ariz.

[73] Assignee: AlliedSignal Inc., Morris Township, Morris County, N.J.

[21] Appl. No.: 170,466

[22] Filed: Dec. 20, 1993

[51] Int. Cl.[6] ..... F02C 7/28

[52] U.S. Cl. ..... 60/39.33; 277/9.5; 403/409.1

[58] Field of Search ..... 60/39.32, 39.33; 415/134, 138, 174.2; 277/9, 9.5, 126, 129; 403/343, 374, 409.1; 411/398, 424

[56] References Cited

U.S. PATENT DOCUMENTS 3,362,160 9/1966 Bourgeois .
3,609,968 10/1971 Mierley et al. ..... 60/39.32
3,841,787 10/1974 Scalzo .
3,892,497 7/1975 Gunderlock et al. .
4,330,234 5/1982 Colley .
4,344,736 8/1982 Williamson .
4,786,204 11/1988 Mayeda ..... 411/398
5,104,141 4/1992 Grove et al. ..... 403/409.1
5,192,185 3/1993 Leonard ..... 415/174.2

*Primary Examiner*—Louis J. Casaregola
*Attorney, Agent, or Firm*—James W. McFarland

[57] ABSTRACT

A seal compression tool is disposed at a readily accessible location externally of the cylindrical casing of a gas turbine engine, and has a camming surface thereon effective to interengage and axially shift the turbine nozzle of the gas turbine engine. Such axial shifting uniformly and controllably compresses a static seal carried between the turbine nozzle and the casing at a remote, relatively inaccessible location inside the gas turbine engine.

9 Claims, 1 Drawing Sheet

SEAL COMPRESSION TOOL FOR GAS TURBINE ENGINE

TECHNICAL FIELD

This invention pertains to gas turbine engines, and pertains more particularly to an improved tool for facilitating compression of relatively large static seals that are disposed at remote, inaccessible locations in the gas turbine engine.

BACKGROUND OF THE INVENTION

Gas turbine engines conventionally include static compression seals which are operable to control internal air leakage between static components. For example, in either the compressor section or turbine section of a gas turbine engine, an outer casing encloses compressor and turbine nozzles. Such nozzles are static structures including a plurality of stator vanes that extend radially into the primary stream of air flow or gas flow through the engine, the vanes operating to alter the angle of incidence of such air flow on to the next adjacent compressor or turbine as the case may be. In many applications such nozzles include an annularly shaped outer support ring from which the stator vanes extend radially inwardly. It is important in such situations to seal between the casing and the annular support ring of the nozzle to minimize internal air leakage.

Often such compression seals are located in remote, quite inaccessible locations. In such instances, compression of the seal, which is normally metallic, may be a difficult assembly process. Typically, relatively large arbor presses are often utilized to force the relatively large annular support ring axially to compress the seal. Because of their inaccessibility, such compression seals may be subject to "hidden" damage through improper or over compression thereof during assembly.

SUMMARY OF THE INVENTION

Accordingly, it is the primary object of the present invention to provide an improved member or tool for effecting compression of a relatively inaccessible annular, ring-like static seal in a gas turbine engine, the tool or member being located in a readily accessible location.

More particularly, it is an important object of the present invention to provide such a seal compression tool or member which extends radially inwardly through the casing, is engageable with the support ring of a compressor or turbine nozzle, the member being rotatable about a radial axis to drive a cam surface thereof axially in order to axially shift the annular support ring relative to the outer casing to axially compress the seal. In this manner, the present invention allows straight forward, predictable compression of the inaccessible seal without utilization of such items as arbor presses.

These and other objects and advantages of the present invention are specifically set forth in or will become apparent from the following detailed description of a preferred embodiment of the invention, when read in conjunction with the accompanying drawing.

DETAILED DESCRIPTION OF THE PREFERRED EMBODIMENT

Figure 1:
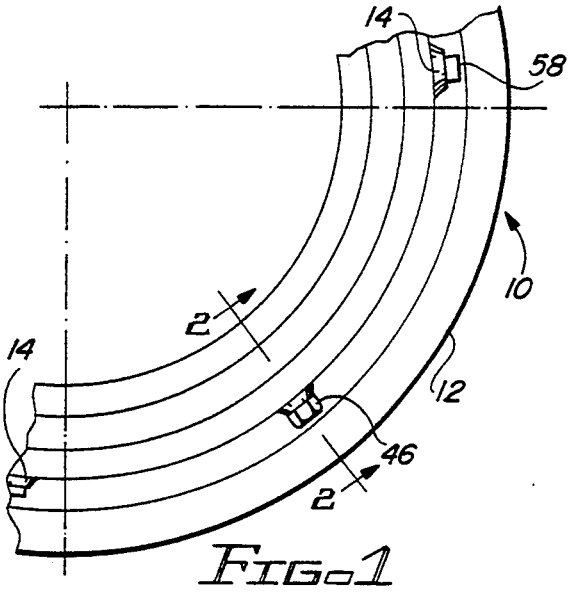
FIG. 1 is a partial front plan view of a turbine casing construction in accordance with the principles of the present invention.
Figure 3:
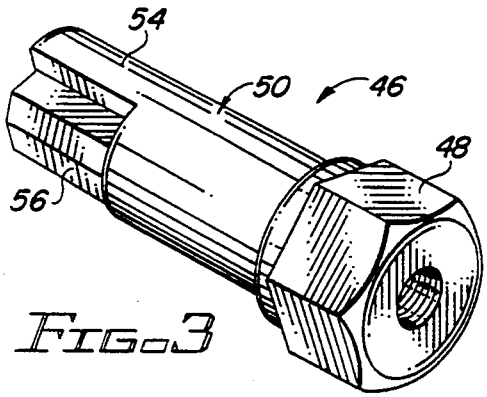
FIG. 3 is a perspective view of the compression tool as contemplated by the present invention.
Figure 2:
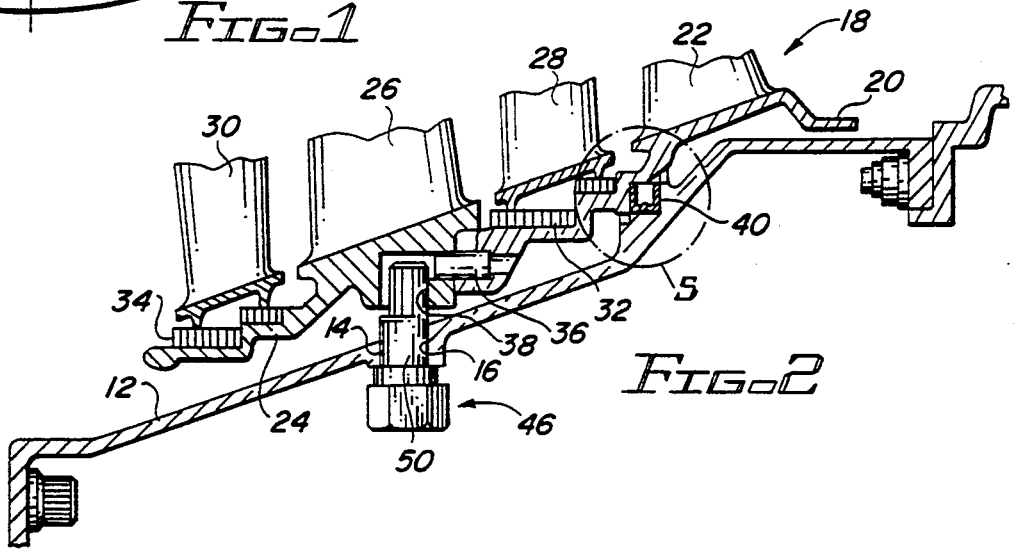
FIG. 2 is a plan cross-sectional view taken along lines 2–2 of FIG. 1.
Figure 4:
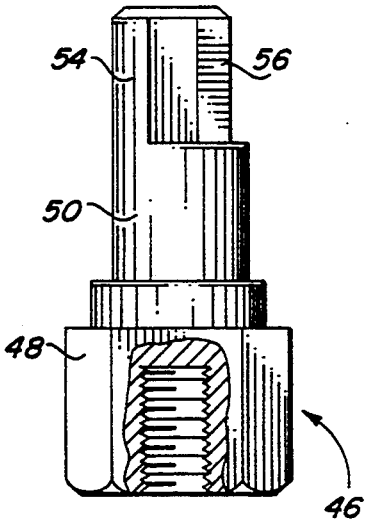
FIG. 4 is a side view of the compression tool.

Referring now more particularly to the drawing, the gas turbine engine generally denoted by the numeral 10 includes a cylindrical, axially extending casing 12. The casing 12 is illustrated as a turbine casing circumscribing an axial turbine section of the engine. The casing has a plurality of bosses 14 thereon spaced about the circumference of the casing at a specified axial locations thereon. Each boss has a circular opening 16 therethrough. An annularly arranged, axially extending turbine nozzle assembly generally denoted by the numeral 18 is disposed within and adjacent to the casing 12. In the embodiment illustrated the turbine nozzle assembly 18 includes a first stage turbine nozzle having an annular outer support ring 20 and a plurality of turbine stator vanes 22 extending radially inwardly from the annularly shaped support ring 20. Assembly 18 includes a second stage turbine nozzle comprising an outer, annular support ring 24 from which a plurality of second stator vanes 26 extend radially inwardly. As common in the art, a first stage set of turbine blading 28 is axially interposed between the first and second stage stator vanes 22, 26. A second stage set of turbine blading 30 is disposed adjacent the second stage stator vanes 26 illustrated in FIG. 2. The rotating turbine blades 28, 30 respectively closely contact abradable material 32, 34 for sealing purposes.

Annular support ring 24 is axially located and carried with the first stage support ring 20 through locating pins 36. In the arrangement illustrated a circular, radial opening 38 in annular support ring 24 is axially located generally adjacent the opening 16 in boss 14.

Figure 5:
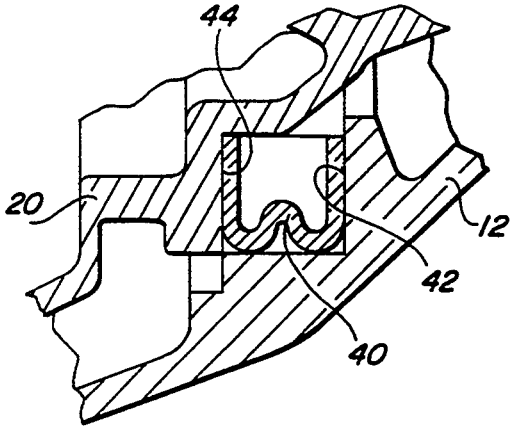
FIG. 5 is an enlarged, partial cross-sectional view of the portion area denoted by line 5–5 of FIG. 2.

An annularly shaped seal 40 is disposed between casing 12 and the first stage support ring 20 to minimize air or gas leakage in the space between the nozzle assembly 18 and casing 12. It will be noted that, typically, the seal 40 is disposed at a relatively inaccessible location substantially axially spaced from the boss 14. As best depicted in FIG. 5, the seal 40 is of metallic structure, and in the embodiment illustrated is referred to as a "E" seal due to the characteristic cross-sectional configuration thereof. The seal 40 has one radial extending face in sealing engagement with the radial face 42 on casing 12, and an opposite radial face on seal 40 similarly sealingly engages a radial surface 44 on support ring 20.

For adequate sealing it is important during assembly that the seal 40 be compressed or squeezed in an axial direction to effect adequate sealing at the adjacent radial faces 42, 44. To this end, the present invention includes a seal compression member or tool generally referred to by the numeral 46. A plurality of such tools or members 46 are insertable within a plurality of the bosses 14 along the circumference of casing 12. Preferably, such a compression member 46 is inserted in each of such bosses 14. Each compression member 46 includes an enlarged external head portion 48 which is disposed externally of and radially outwardly of the associated boss 14. The compression member 46 further includes a smooth, circular reaction surface 50 that closely fits within and is rotatable upon the associated circular surface of opening 16 in the boss. At the radial inward end of compression member 46 is a cam surface 52. As illustrated cam surface 52 includes a first circular section 54 of essentially the same diameter as the reaction surface 50, along with reduced diameter surfaces or flats 56.

During assembly of the gas turbine engine, the compression seal 40 is first placed upon casing surface 42 in an uncompressed state. The turbine nozzle assembly 18 is slipped axially within the casing until the opening 38 therein generally aligns with the associated boss 14, with surface 44 of support ring 20 being located closely adjacent or loosely touching the seal 40. The seal compression members or tools 46 are then inserted radially through the associated openings 16 of the respective bosses 14 with the cam surface 52 thereof extending into opening 38.

Upon initial insertion of tools 46, the reduced diameter portions 56 of the cam surface 52 are facing the compression seal 40. The compression members 46 are then rotated about their respective radial axis to rotate the cam surface 52 causing the enlarged portion 54 thereof to engage the surface 38 in support ring 24. Continued rotation of the tools 46 through about 180° shifts them to the position illustrated in FIG. 2. During such rotation the cam surface 54 bears upon support ring 24 to shift both it and the first stage support ring 20 axially. Relative to FIG. 2 and 5, this is rightward horizontal motion of the support ring 20. This causes sealing surface 44 on support ring 20 to engage and compress seal 40 such that both oppose surfaces thereof are in sealing interengagement with the associated surfaces 42, 44.

In this manner, the compression seal 40 may be uniformly, readily compressed in an axial direction by virtue of the radial rotation of the compression tools 46 which are disposed in a readily accessible location externally of the casing 12. This manner of compression of the seal 40 not only avoids cumbersome arbor presses or like assembly steps in order to compress the seal 40, but also allows more controlled compression of the seal 40 by virtue of the straightforward sequential rotation of the compression members 46.

After proper compression of the seal 40, tools 46 are removed one-at-a-time, and an appropriate locating and retention pin 58 is inserted in to replace the removed tool. Once all the compression tools 46 are replaced by pins 58, the turbine nozzle assembly 18 is secured in the selected axial location relative to the casing 12, with seal 40 compressed.

Various alterations and modifications to the above described embodiment will be apparent to those skilled in the art. Accordingly the foregoing detailed description of a preferred arrangement of the invention should be considered exemplary in nature and not as limiting to the scope and spirit of the invention as set forth in the appended claims.

Having described the invention with sufficient clarity that those skilled in the art may make and use it, what is claimed is:

1. In a gas turbine engine:

an axially extending turbine casing having a radial boss with an opening therein;

a turbine nozzle having an annular support ring disposed within and adjacent said casing, and a plurality of stator vanes extending radially inwardly from said ring;

an axially compressible static seal engageable with said casing and said support ring; and a seal compression member extending radially inwardly through said opening in the boss, said member having a cylindrical reaction surface engaging and rotatable on said boss, and a cam surface engaging said support ring, said member rotatable about a radial axis to urge said cam surface to axially shift said support ring and axially compress said static seal between said ring and said casing.

2. A gas turbine engine as set forth in claim 1, wherein said compression member is axially spaced from said seal.

3. A gas turbine engine as set forth in claim 2, wherein said cam surface is disposed radially inwardly of said reaction surface.

4. A gas turbine engine as set forth in claim 3, further including a plurality of said bosses disposed about the circumference of said casing, and a plurality of said compression members received in said bosses.

5. A gas turbine engine as set forth in claim 4, wherein said seal has opposed radial sealing surfaces sealingly engageable with mating radial surfaces of said ring and said casing.

6. A gas turbine engine as set forth in claim 5, wherein said turbine nozzle comprises a first stage nozzle with associated support ring and stator vanes, and a second stage nozzle with associated support ring and stator vanes, said first and second nozzles being axially spaced.

7. A gas turbine engine as set forth in claim 6, further including means for interconnecting said first and second nozzles.

8. A gas turbine engine as set forth in claim 7, wherein said cam surface is engageable with said second stage nozzle support ring, said seal sealing surface being sealingly engageable with said first stage nozzle support ring.

9. In a gas turbine engine:

an axially extending, cylindrical casing having a radial boss with an opening therein;

nozzle structure including an annular support ring disposed within and adjacent said casing, and a plurality of stator vanes extending radially inwardly from said ring;

an axially compressible static seal engageable with said casing and said support ring; and a seal compression member extending radially inwardly through said opening in the boss, said member having a cylindrical reaction surface engaging and rotatable on said boss, and a cam surface engaging said support ring, said member rotatable about a radial axis to urge said cam surface to axially shift said support ring relative to said casing and axially compress said static seal between said ring and said casing.

* * * * *